US008468716B1

(12) United States Patent
Walker et al.

(10) Patent No.: US 8,468,716 B1
(45) Date of Patent: Jun. 25, 2013

(54) PRESSURIZED DRYING SYSTEM

(76) Inventors: Mary A. Walker, Hesperia, CA (US); Mark S. Walker, Hesperia, CA (US)

( * ) Notice: Subject to any disclaimer, the term of this patent is extended or adjusted under 35 U.S.C. 154(b) by 604 days.

(21) Appl. No.: 12/257,300

(22) Filed: Oct. 23, 2008

Related U.S. Application Data

(60) Provisional application No. 60/982,073, filed on Oct. 23, 2007.

(51) Int. Cl.
*F26B 11/00* (2006.01)

(52) U.S. Cl.
USPC ..... 34/435; 34/235; 392/379; 15/405; 415/1

(58) Field of Classification Search
USPC .... 34/381, 413, 443, 104, 105, 235; 392/379, 392/383; 15/405, 406; 415/1, 101, 204, 206
See application file for complete search history.

(56) References Cited

U.S. PATENT DOCUMENTS

| | | | | | |
|---|---|---|---|---|---|
| 532,592 | A | * | 1/1895 | Schubbert | 96/118 |
| 1,016,435 | A | * | 2/1912 | Overholt | 34/611 |
| 1,661,553 | A | * | 3/1928 | Louis Baar | 392/379 |
| 1,703,551 | A | * | 2/1929 | Singer | 15/330 |
| 1,749,448 | A | * | 3/1930 | Sculthorpe | 34/437 |
| 2,122,964 | A | * | 7/1938 | Sweetland | 34/509 |
| 2,308,310 | A | | 1/1943 | Ruemelin, Jr. et al. | |
| 2,410,353 | A | * | 10/1946 | McCollum | 126/110 B |
| 2,427,477 | A | | 9/1947 | Shapiro | |
| 2,535,144 | A | * | 12/1950 | Kovacs et al. | 96/120 |
| 2,592,578 | A | * | 4/1952 | Kogl | 249/14 |
| 2,664,809 | A | * | 1/1954 | Morell | 454/271 |
| 2,764,929 | A | * | 10/1956 | Tegarty | 454/271 |
| 2,779,065 | A | * | 1/1957 | Rehme | 52/302.1 |
| 2,782,464 | A | * | 2/1957 | Joppich | 52/302.3 |
| 2,940,777 | A | | 6/1960 | Lundberg | |
| 2,969,027 | A | * | 1/1961 | Figge | 52/22 |

(Continued)

FOREIGN PATENT DOCUMENTS

| | | | |
|---|---|---|---|
| DE | 3430893 | A1 * | 5/1985 |
| DE | 3418326 | A1 * | 11/1985 |

(Continued)

OTHER PUBLICATIONS

U.S. Appl. No. 12/035,902, filed Feb. 22, 2008, Mark S. Walker.

(Continued)

*Primary Examiner* — Steve M Gravini
(74) *Attorney, Agent, or Firm* — Knobbe, Martens, Olson & Bear, LLP

(57) ABSTRACT

A system for drying structures including an enclosed housing with a plurality of outlet openings, a plurality of flexible outlet hoses each connected to a respective outlet opening, and a vacuum motor engaged with the housing such that an outlet of the vacuum motor is exhausted into an interior of the housing so as to pressurize the interior of the housing such that compressed air is directed through the plurality of outlet hoses. Also a method of drying an interior of a structure, including placing a pressurized drying system adjacent a region of a structure, forming a plurality of openings in surfaces of the structure where the surfaces define enclosed spaces, inserting distal ends of outlet hoses of the pressurized drying system into respective openings of the surfaces of the structure, and engaging the pressurized drying system so as to generate a flow of pressurized air and to direct the pressurized air into the enclosed spaces.

20 Claims, 6 Drawing Sheets

U.S. PATENT DOCUMENTS

| | | | | | |
|---|---|---|---|---|---|
| 3,001,332 | A | * | 9/1961 | Wilder | 52/302.1 |
| 3,007,256 | A | * | 11/1961 | Rouy | 34/237 |
| 3,052,987 | A | * | 9/1962 | Mercer | 34/441 |
| 3,057,285 | A | * | 10/1962 | Wheeler | 454/339 |
| 3,115,567 | A | * | 12/1963 | Meltzer | 392/384 |
| 3,233,627 | A | | 2/1966 | Cebula | |
| 3,324,846 | A | | 6/1967 | Smith | |
| 3,487,557 | A | * | 1/1970 | Linstead | 34/619 |
| 3,659,077 | A | * | 4/1972 | Olson | 219/213 |
| 3,729,614 | A | * | 4/1973 | Martinet | 219/528 |
| 3,796,551 | A | * | 3/1974 | Pope | 422/143 |
| 3,805,405 | A | * | 4/1974 | Ambos | 34/104 |
| 3,994,525 | A | * | 11/1976 | Breitschwerdt et al. | 296/220.01 |
| 4,000,620 | A | | 1/1977 | Burge | |
| 4,183,292 | A | * | 1/1980 | Banks | 99/468 |
| 4,251,032 | A | | 2/1981 | Werding | |
| 4,391,619 | A | | 7/1983 | Shono et al. | |
| 4,571,849 | A | * | 2/1986 | Gardner et al. | 34/79 |
| 4,732,562 | A | * | 3/1988 | Palsson | 432/224 |
| 5,069,114 | A | | 12/1991 | Sodec et al. | |
| 5,145,216 | A | | 9/1992 | Valls, Jr. | |
| 5,155,924 | A | * | 10/1992 | Smith | 34/443 |
| 5,165,604 | A | | 11/1992 | Copp, Jr. | |
| 5,174,048 | A | | 12/1992 | Shero | |
| 5,214,860 | A | * | 6/1993 | Landes | 34/441 |
| 5,408,759 | A | * | 4/1995 | Bass | 34/104 |
| 5,419,059 | A | * | 5/1995 | Guasch | 34/443 |
| 5,456,023 | A | | 10/1995 | Farnan | |
| 5,555,643 | A | * | 9/1996 | Guasch | 34/443 |
| 5,590,478 | A | * | 1/1997 | Furness | 34/437 |
| 5,599,229 | A | | 2/1997 | Claunch et al. | |
| 5,611,151 | A | * | 3/1997 | Jacob | 34/395 |
| 5,709,412 | A | | 1/1998 | Vadas | |
| 5,727,330 | A | * | 3/1998 | Cucchi et al. | 34/86 |
| 5,761,827 | A | * | 6/1998 | Guasch | 34/413 |
| 5,813,139 | A | | 9/1998 | Lillicotch | |
| 5,893,216 | A | * | 4/1999 | Smith et al. | 34/103 |
| D412,381 | S | * | 7/1999 | Peet | D32/58 |
| 5,926,972 | A | * | 7/1999 | Di Peso | 34/128 |
| 5,960,556 | A | * | 10/1999 | Jansen | 34/402 |
| 5,991,966 | A | * | 11/1999 | Sproule | 15/310 |
| 6,116,749 | A | * | 9/2000 | Quiogue et al. | 362/148 |
| 6,125,538 | A | | 10/2000 | Vadas | |
| 6,215,955 | B1 | * | 4/2001 | Sloan | 392/383 |
| 6,216,359 | B1 | * | 4/2001 | Peet | 34/105 |
| 6,367,945 | B2 | * | 4/2002 | Quiogue et al. | 362/147 |
| 6,647,639 | B1 | * | 11/2003 | Storrer | 34/104 |
| 6,662,467 | B2 | | 12/2003 | Cressy et al. | |
| 6,691,427 | B1 | * | 2/2004 | Fernandes et al. | 34/60 |
| 6,705,939 | B2 | * | 3/2004 | Roff | 454/185 |
| 6,739,070 | B1 | | 5/2004 | Jacobs et al. | |
| 6,740,810 | B1 | * | 5/2004 | Regueiro | 174/51 |
| 6,871,880 | B1 | | 3/2005 | Olson | |
| 6,886,271 | B2 | * | 5/2005 | Storrer | 34/92 |
| 7,036,209 | B1 | * | 5/2006 | Wago et al. | 29/603.2 |
| 7,047,664 | B1 | * | 5/2006 | Martinez | 34/380 |
| 7,059,638 | B2 | | 6/2006 | Charrette et al. | |
| 7,137,308 | B2 | * | 11/2006 | Harris | 73/865.8 |
| 7,183,524 | B2 | * | 2/2007 | Naylor et al. | 219/528 |
| 7,230,213 | B2 | * | 6/2007 | Naylor | 219/528 |
| 7,243,442 | B2 | * | 7/2007 | Myerholtz et al. | 34/103 |
| 7,695,007 | B2 | * | 4/2010 | Cord | 280/734 |
| 7,716,849 | B1 | * | 5/2010 | Hicks | 34/104 |
| 7,785,064 | B2 | * | 8/2010 | Bartholmey et al. | 415/1 |
| 7,841,087 | B1 | * | 11/2010 | Walker, Jr. | 29/890.144 |
| 7,880,121 | B2 | * | 2/2011 | Naylor | 219/213 |
| 2005/0252380 | A1 | | 11/2005 | Gastaldi et al. | |
| 2006/0000110 | A1 | | 1/2006 | Aisenberg et al. | |
| 2006/0049615 | A1 | | 3/2006 | Day | |
| 2006/0143936 | A1 | | 7/2006 | Studebaker | |

FOREIGN PATENT DOCUMENTS

| | | | | |
|---|---|---|---|---|
| DE | 4110765 | A1 | * | 10/1992 |
| DE | 4206190 | A1 | * | 5/1993 |
| EP | 85757 | A1 | * | 8/1983 |
| JP | 59059235 | A | * | 4/1984 |
| JP | 59120068 | A | * | 7/1984 |
| JP | 60005258 | A | * | 1/1985 |
| JP | 60030957 | A | * | 2/1985 |
| JP | 63271045 | A | * | 11/1988 |
| JP | 01100498 | A | * | 4/1989 |
| JP | 01227800 | A | * | 9/1989 |
| JP | 02024536 | A | * | 1/1990 |
| JP | 02056291 | A | * | 2/1990 |
| JP | 02193685 | A | * | 7/1990 |
| JP | 03028462 | A | * | 2/1991 |
| WO | WO 9825507 | A1 | * | 6/1998 |
| WO | WO 9911116 | A1 | * | 3/1999 |
| WO | WO 2004048870 | A1 | * | 6/2004 |
| WO | WO 2006062383 | A1 | * | 6/2006 |
| WO | WO 2007002700 | A2 | * | 1/2007 |

OTHER PUBLICATIONS

U.S. Appl. No. 12/035,902, filed Feb. 22, 2008, Mark S. Walker, Restriction Requirement dated May 3, 2010 and Response, Notice of Allowability dated Aug. 20, 2010.

U.S. Appl. No. 12/860,474, filed Aug. 20, 2010, Mark S. Walker.

* cited by examiner

PRESSURIZED DRYING SYSTEM

CROSS-REFERENCE TO RELATED APPLICATIONS

This application claims the priority benefits of U.S. Provisional Application 60/982,073 filed Oct. 23, 2007 and which is incorporated herein by reference in its entirety.

BACKGROUND OF THE INVENTION

1. Field of the Invention

The invention relates to the field of flood/water damage remediation and to a system of providing pressurized drying air to a plurality of user selectable locations.

2. Description of the Related Art

Flooding or otherwise unwanted release or flow of water is a common and widespread cause of potentially expensive damages to property in many locations throughout the world. Flood damage can rise from natural sources such as overflowing rivers and lakes, rising rainwaters, rapid snow melt, mudslides, storm surges, wind-driven rain, tidal action, wave action, and the like. Water damage can also occur from malfunctions or breaks in manmade water delivery and/or storage systems. For example, broken levies or dams can release free flowing water. Broken water hoses or pipes within a building can also release significant quantities of water within the structure. Failure or breakage of water pipes can occur due to many causes including but not limited to pressure of frozen pipes, mechanical stress such as from earthquakes or wind loading, age and deterioration, and failures in joints or valves in the water system.

Flooding or other undesired release or accumulation of water within structures can be particular troublesome as the flooding or otherwise undesired water release can occur when a structure is unoccupied. In addition, a flooding event frequently indicates that the affected areas remain evacuated for some period of time. Thus the undesired exposure of the structure to water can occur for an extended period of time.

A further problematic aspect of flooding and water damage is that additional secondary damage resulting from the water exposure can occur, particularly if the water is not quickly removed and any residual moisture dissipated. For example, extended presence of flood water, mud, or other released water can facilitate growth of mold and/or mildew within a structure. Once established, mold and mildew are particularly difficult to exterminate. This can result in the requirement for removing and replacing materials within the structure, including potentially structural materials, to remove the mold and mildew growth. Such secondary impacts can add significantly to the cost of restoration/remediation above any direct damages caused by the water itself.

SUMMARY OF THE INVENTION

It will be appreciated that there is therefore a need to rapidly and thoroughly dry the interior of a structure that has been exposed to undesired release of water. The drying is also preferably carried out in a relatively inexpensive manner, particular as flood events frequently affect a large number of individual structures. It is also desired to rapidly and inexpensively dry the interior of structures, including regions or volumes that may be obscured from view and have limited access. For example, residual moisture remaining in the interior of enclosed wall structures, e.g., between opposed panels of drywall forming part of a structure wall, are not readily accessed by existing drying equipment, thereby making the drying of these enclosed volumes for mitigation of water exposure more problematic.

One embodiment includes a system for drying structures, the system comprising an enclosed housing comprising a plurality of outlet openings, a plurality of flexible outlet hoses each connected to a respective outlet opening, and a vacuum motor comprising an air inlet and engaged with the housing such that an outlet of the vacuum motor is exhausted into an interior of the housing so as to pressurize the interior of the housing such that compressed air is directed through the plurality of outlet hoses.

Another embodiment includes a method of drying an interior of a structure, the method comprising placing a pressurized drying system adjacent a region of a structure that is desirably dried, forming a plurality of openings in surfaces of the structure where the surfaces define enclosed spaces, inserting distal ends of outlet hoses of the pressurized drying system into respective openings of the surfaces of the structure, and engaging the pressurized drying system so as to generate a flow of pressurized air and to direct the pressurized air into the enclosed spaces.

DETAILED DESCRIPTION OF THE PREFERRED EMBODIMENT

Figure 1:
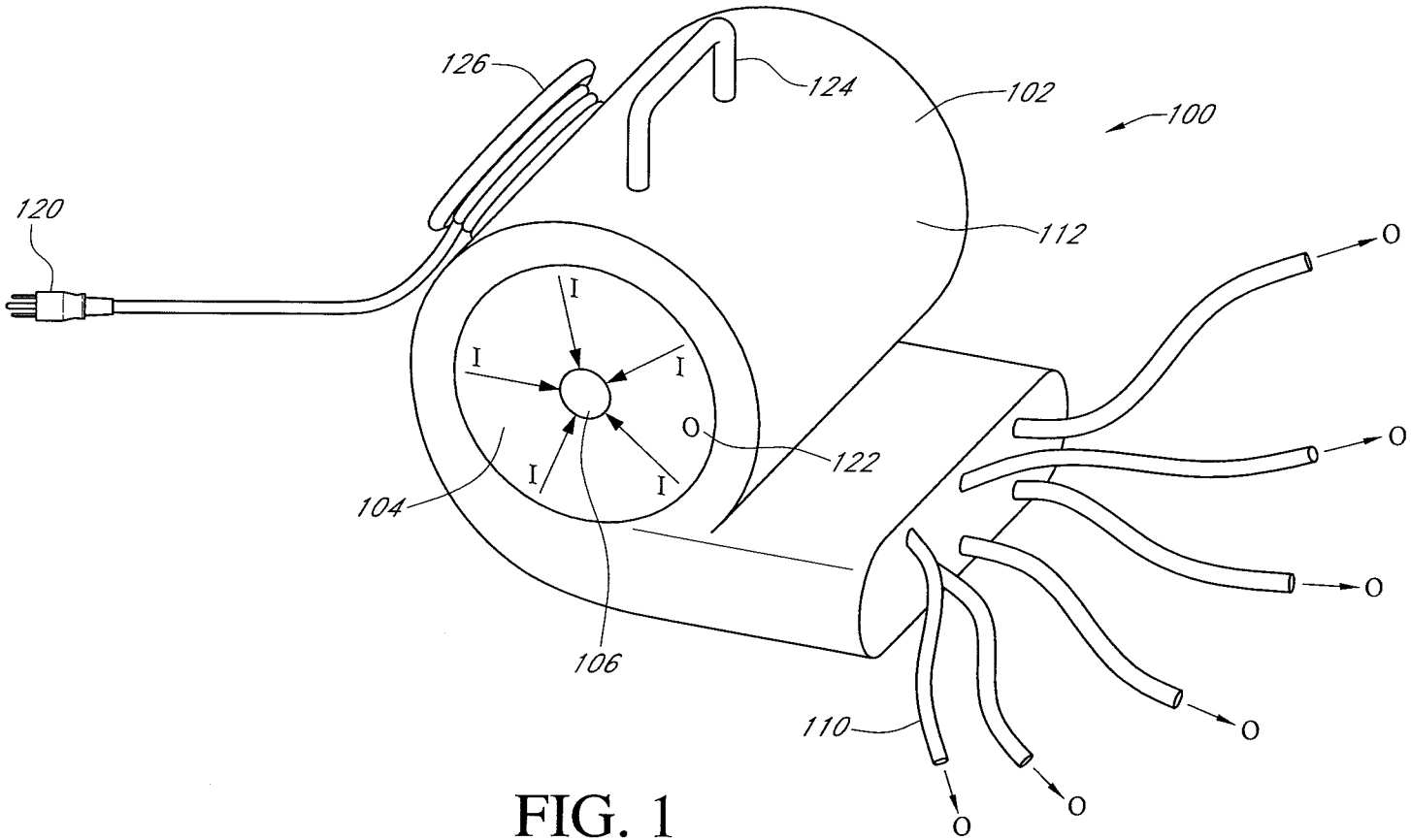
FIG. 1 is a perspective view of one embodiment of a pressurized drying system.

Reference will now be made to the drawings wherein like reference numerals refer to like parts of processes throughout. FIG. 1 illustrates a perspective view of one embodiment of a pressurized drying system 100. The pressured drying system 100 is configured to generate a plurality of streams of pressurized air and to direct these streams to a plurality of user selectable locations. As will be described in greater detail below following a more complete description of the components and construction of the system 100, the system 100 greatly improves the ability of users to rapidly dry the interior of structures that have been exposed to flooding or other water damage in an inexpensive and easy to use manner.

In one embodiment, the system 100 includes a generally sealed or enclosed housing 102. The housing 102 is preferably formed of a durable, strong, and relatively lightweight material and in some embodiments comprises molded plastic. The housing 102 is also preferably formed of materials and/or providing with coatings that are resistant to water damage as the system 100 can be expected to be used in locations where standing water and/or high relative humidities can be expected.

In some embodiments, the system 100 also comprises a vacuum motor assembly 104. The vacuum motor assembly 104 is configured to generate a relatively high speed and high flow rate of air and to direct this air into an interior 112 of the housing 102. The vacuum motor assembly 104 can comprise a multi-stage design, such as a dual stage or three stage design. In some embodiments, the vacuum motor assembly 104 can be constructed to discharge the air flow in a generally tangential manner. A tangential discharge aspect of the vacuum motor assembly 104 can cooperate with a generally spiral cross-sectional shape of the housing 102 to facilitate more efficient pressurization of air and outward direction of air flow from the system 100.

In some embodiments, the vacuum motor assembly 104 preferably generates an air flow in the range of approximately 50 to 150 cubic feet per minute (cfm). Such a range of flow rates will provide, in at least some preferred applications, a sufficient flow of air to effectively assist drying, while avoiding an excessive flow of air that might otherwise cause damage. In one nonlimiting preferred embodiment, the vacuum motor assembly 104 preferably provides a flow of approximately 95 cfm.

As previously described, a desired aspect of the system 100 is the ability to provide a relatively high flow rate of moderately pressurized air. Highly pressurized air, for example on the order of multiple tens of psig or more is undesired as such high pressures are less effective at speeding the drying process and can also result in damage from the high pressure air impinging on the structure or other materials, furnishings, personnel, and the like in the work area. An additional difficulty is that excessively pressurized air can result in difficulties in maintaining air flow at a desired location as excessively pressurized air can tend to dislodge or move a hose providing the air.

However, it is desired that the relatively high flow airstream be provided at a moderate degree of pressurization to speed the drying process, by for example to facilitate circulation of air in spaces that may be obstructed or occluded from the direct path of the system 100. In some preferred embodiments, a pressure in the interior 112 of the housing 102 of approximately 2 to 6 psig provides an appropriate moderate level of pressurization for the system 100. In these embodiments, a vacuum motor assembly 104 capable of generating approximately 100 to 150 inches of water vacuum provides an appropriate level of pressurization of the interior 112 of the housing 102. Such embodiments of vacuum motor assembly 104 can draw an operating power of approximately 1500 watts at a standard line voltage of 120 volts AC. Thus, the system 100 with the vacuum motor assembly 104 can operate on standard wall electrical service and does not require supplemental generators or nonstandard power sources.

The vacuum motor assembly 104 and system 100 include one or more air intakes 106. In some embodiments, the air intake 106 comprises an opening of the vacuum motor 104 that in other applications can be connected to one or more hoses or plenums to generate a depressed pressure area, for example for vacuuming/suctioning purposes. In the system 100, the air intake 106 provides a conduit for intake of air indicated by the designator I in FIG. 1, through the vacuum motor assembly 104, and into the interior 112 of the housing 102. In some implementations however, the air intake 106 can also be utilized to take up a variety of compounds to facilitate the remediation process employing the system 100 following flood or other water damage. For example, one or more antibiological agents can be conveyed to the system 100 via the air intake 106, for example to disburse such agents to suppress growth of mold and mildew. Agents such a smoke and/or fogging agents can also be admitted via the air intake 106, for example for disbursal via the system 100 to assist in leak detection.

The system 100 also preferably comprises one or more outlet hoses 110. The outlet hoses 100 provide a path for outlet air (indicated by the designator O in FIG. 1) from the interior 112 of the housing 102 to desired locations selected by the user in a water damage remediation process. As the particular configuration of a structure that has been exposed to water damage and the particular locations within such a structure in need of drying can vary significantly from job to job, the outlet hoses 110 preferably comprise flexible material such as flexible tubing or hosing.

In some embodiments, the system 100 also provides a moderate amount of heating to the outlet air O. In some embodiments, the system 100 heats air approximately 30-50° F. above ambient. Thus, in some embodiments, the system 100 can draw in air at approximately 70° F. and provide pressurized air via the outlet hoses 100 of approximately 100-120° F.

In this embodiment, the system 100 comprises a power cord 120 that includes a connector for electrical connection to standard wall service so as to provide electrical power to the system 100. The system 100 also comprises one or more controls 122 to regulate the operation of the system 100. In some embodiments, the control 122 comprises a single pole on/off type switch. In some embodiments, the control 122 can regulate a speed of operation of a variable speed vacuum motor assembly 104. In some embodiments, the system 100 further comprises a carrying handle 124 configured to facilitate movement and repositioning of the system 100. The system 100 can also comprise a cord reel 126 configured to receive and store for convenient deployment the power cord 120.

Figure 2:
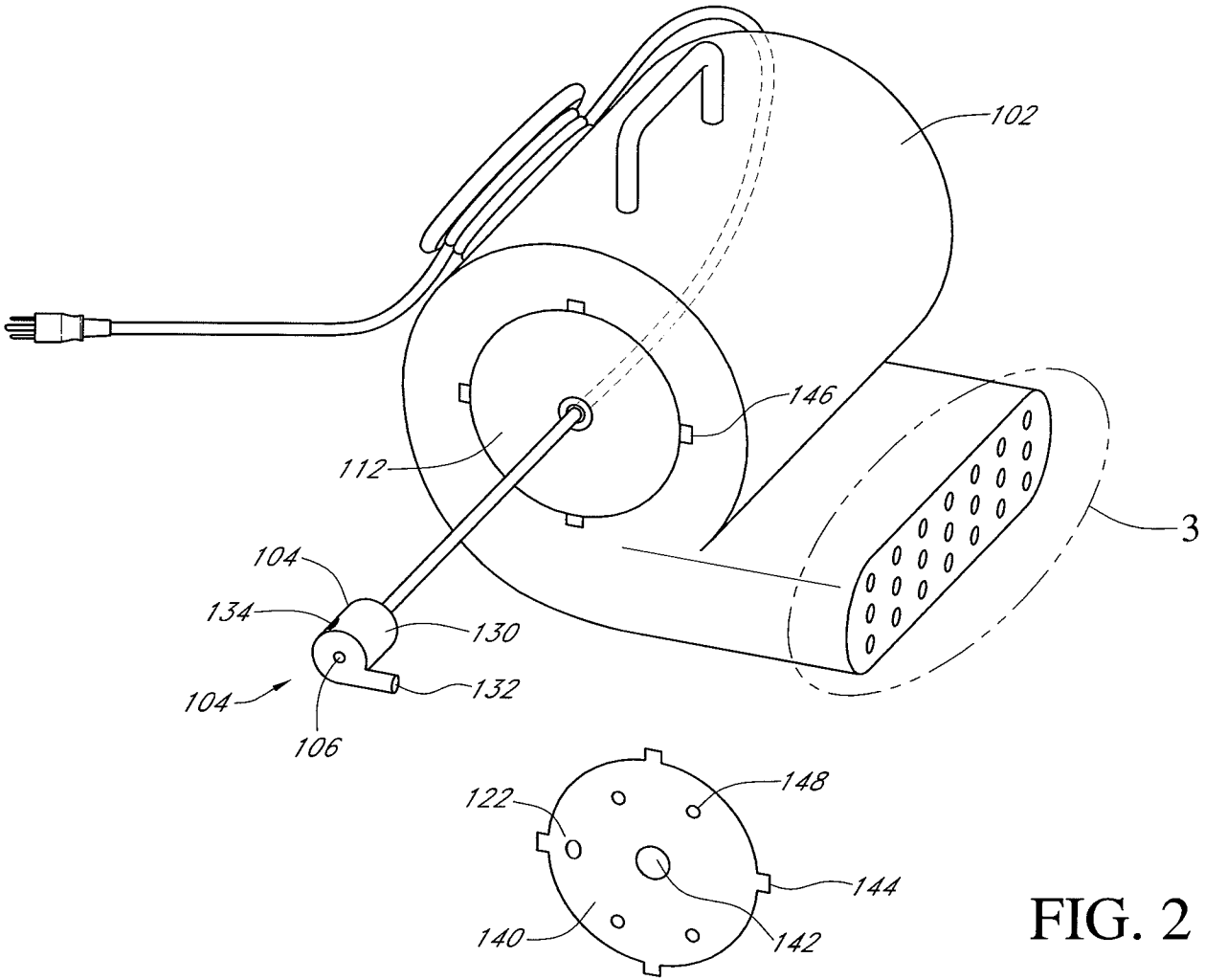
FIG. 2 is an exploded perspective view of one embodiment of a pressurized drying system.

FIG. 2 illustrates an exploded perspective view of embodiments of the pressurized drying system 100. In this embodiment, the vacuum motor assembly 104 comprises a separate component that can be connected or engaged with the housing 102. In this embodiment, the vacuum motor assembly 104 comprises a vacuum motor 130 having a vacuum outlet 132 and the air intake 106. As previously noted, in some embodiments the vacuum outlet 132 can be configured as a tangential outlet.

In some embodiments, the vacuum motor assembly 104 can further comprise thermal protection 134. The thermal protection 134 automatically monitors one or more temperatures of the system 100, for example a temperature of the vacuum motor 130. If acceptable operating temperature thresholds are exceeded, the thermal protection 134 can automatically interrupt operation of the vacuum motor 130 to allow temperatures to return to acceptable levels. In some embodiments, the thermal protection 134 can also operate automatically to restore operation of the vacuum motor 130 when temperatures return to acceptable levels. In one nonlimiting embodiment, the thermal protection 134 interrupts operation when internal temperatures exceed approximately 215° F. and restores operation when temperatures drop below approximately 180° F.

In one embodiment, the vacuum motor assembly 104 further comprises a mounting plate 140 comprising an opening 142 configured to align with and conform generally to the size and location of the air intake 106. In one embodiment, the mounting plate 140 comprises one or more mounting tabs 144 configured to engage with corresponding mounting points 146 of the housing 102. The mounting plate 140 can be attached to the housing 102, for example via fasteners, adhesives, welding, friction fit, detents, tabs, and the like. The mounting plate 140 can also be connected to the vacuum motor 130, for example via a plurality of fasteners 148.

In some embodiments, for example as illustrated in FIG. 2, connection of the mounting plate 140 to the housing 102 and the vacuum motor 130 is nonpermanent. In these embodiments, one or more components of the system 100 can be interchanged. For example, a different power cord 120 and/or vacuum motor 130 can be provided to match the characteristics of electrical grid service at a particular location. Likewise, a vacuum motor 130 can be replaced with a different vacuum motor 130 having different performance characteristics suitable for the requirements of a particular application. Interchangeability of parts of the system 100 provides increased flexibility to a user and reduced cost of operation by providing the option of replacing worn components and/or substituting components of desired performance characteristics without replacement of remaining components of the system 100.

Figure 3:
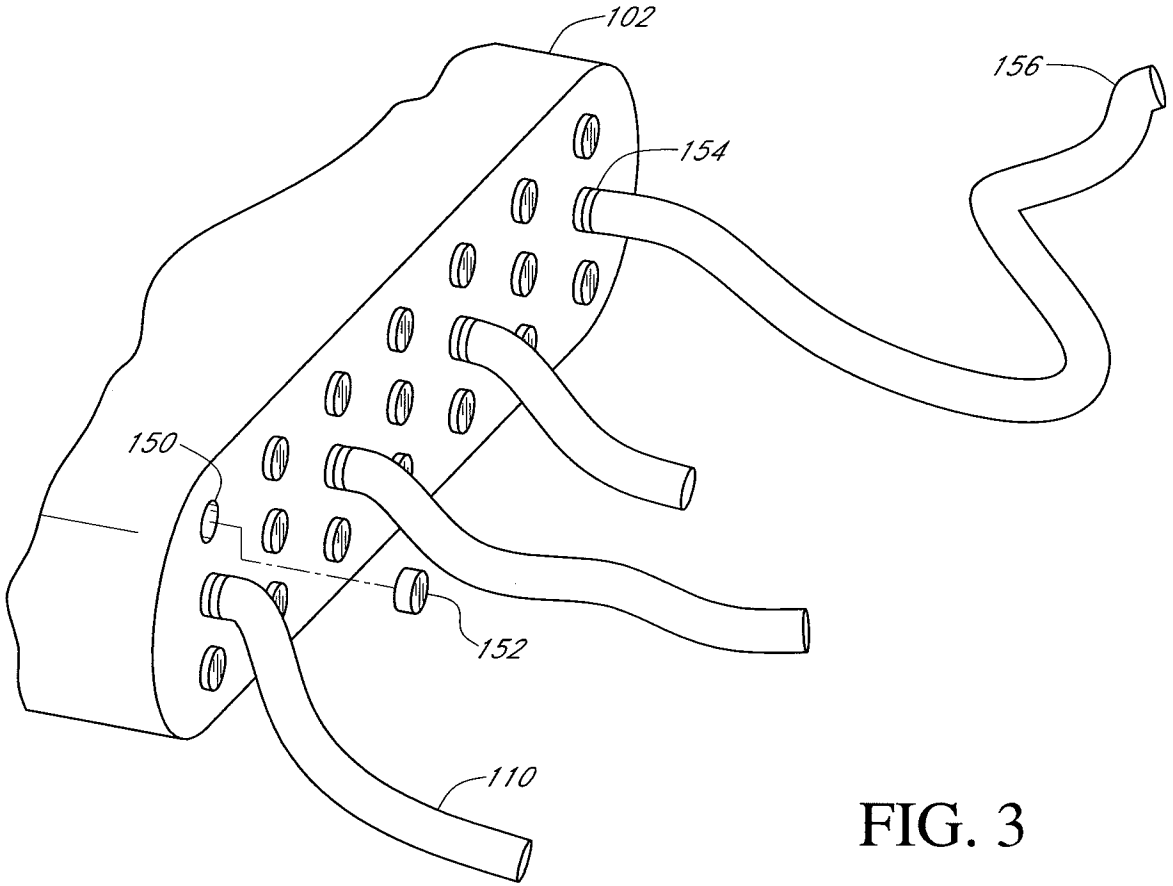
FIG. 3 is a perspective detail view of one embodiment of a pressurized drying system and an outlet region thereof.

FIG. 3 illustrates in greater detail an outlet portion of the housing 102 and system 100. As can be seen, the housing 102 comprises a plurality of openings 150. In one nonlimiting example, the housing 102 comprises an array of openings 150 arranged in a generally rectangular grid of three rows of seven columns for a total of 21 openings 150.

Figure 6:
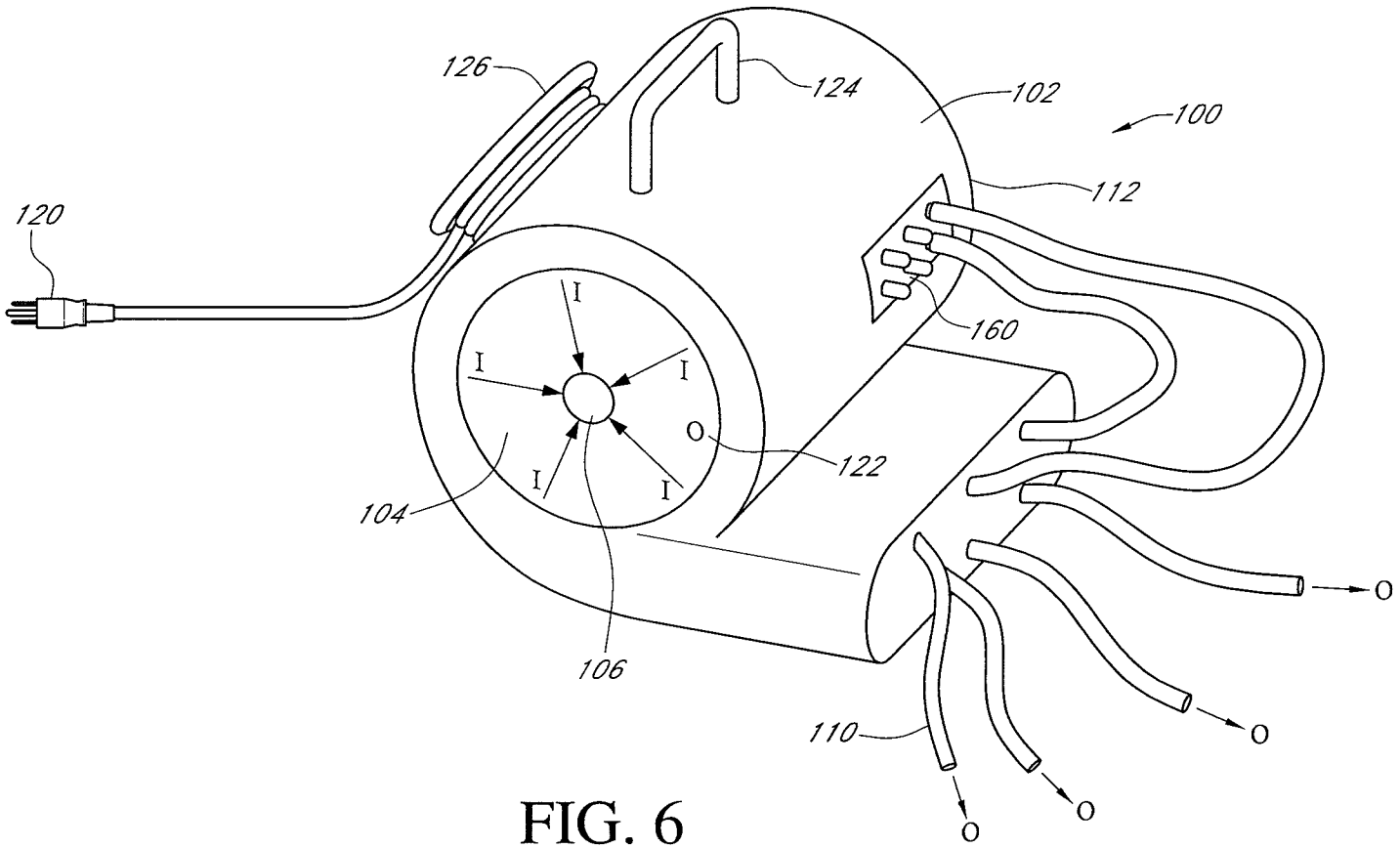
FIG. 6 is a perspective view of another embodiment of a pressurized drying system.

As previously noted, a particular worksite where the system 100 is to be employed can have significantly different physical characteristics and drying needs than another. For example, a given job may require less than the full number of available openings 150 provided by the housing 102 and associated outlet hoses 110. In one embodiment described in greater detail below with respect to FIG. 6, the system 100 can comprise a plug off assembly 160 configured to accept unused outlet hoses 110. In another embodiment, the system 100 can comprise one or more plugs 152 which are sized and shaped for removable attachment in a respective opening 150 so as to provide a removable but substantially airtight seal therebetween.

The system 100 also comprises one or more fittings 154 which are also configured and sized to removably engage with a corresponding opening 150 in a generally airtight manner. A length of flexible hose 156 can be attached to the fitting 154 so as to comprise one of the outlet hoses 110.

In some embodiments, the combination of the plugs 152 and outlet hoses 110 provides great flexibility to a user in obtaining a desired number and characteristics of outlet airflows O from the system 100. For example, use of a larger number of plugs 152 with a corresponding smaller number of outlet hoses 110 will generally result in a greater air flow through a given individual outlet hose 110. Conversely, connection of a greater number of outlet hoses 110 with a corresponding lesser number of plugs 152 will generally result in a lower airflow O through a given individual outlet hose 110. In order to maintain a desired outlet flow O through the one or more outlet hoses 110, it will generally be preferred that during use each opening 150 have engaged therewith either a plug 152 or a fitting 154 with attached flexible hose 156, however this is not a requirement.

In some embodiments, it will be preferred that substantially all available openings 150 be provided with attached outlet hoses 110, for example comprising a fitting 154 and associated hose 156. For example, in some embodiments, plugging an excessive number of outlet hoses 110 and/or opening 150 can result in overpressurization of the housing 102. The plug-off assembly 160 (FIG. 6) provides a location for a user to secure unused outlet hoses 110. The user can attach distal ends of the outlet hoses 110 to mounting features of the plug-off assembly 160. The plug-off assembly 160 is configured such that the mounting features allow the pressurized air flow from the outlet hoses 110 to bleed off without over pressurizing the interior 112 of the housing 102. The plug-off assembly 160 secures the unused outlet hoses 110 and provides a visual indication of the number and location of any unused outlet hoses 110. The plug-off assembly also provides deterrence to a user plugging unused openings 150 or outlet hoses 110 thereby possibly leading to overpressurization of the system 100 and possible attendant damage or overheating.

Figure 4:
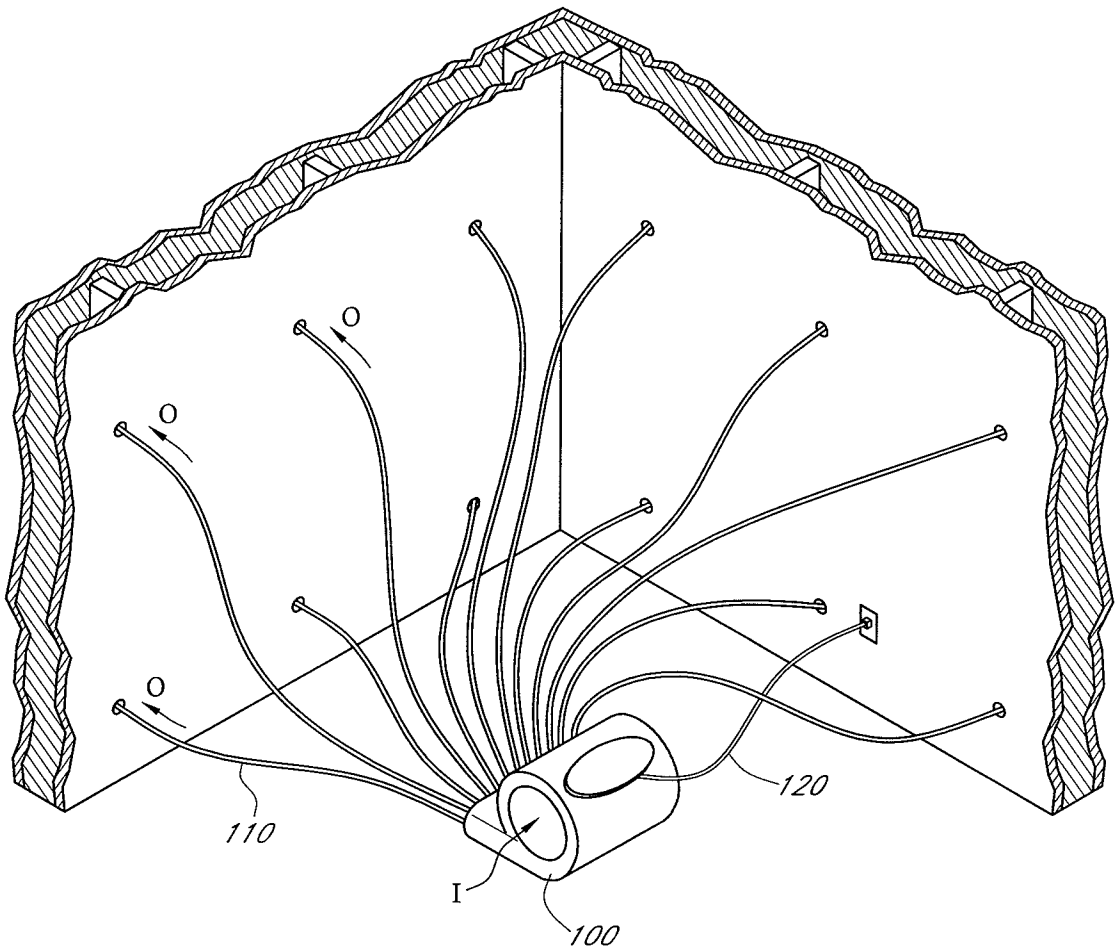
FIG. 4 is a perspective view of emplacement and use of one embodiment of a pressurized drying system.

FIG. 4 illustrates schematically one embodiment of use of the system 100. The system 100 is shown connected to a wall-mounted electrical outlet via the power cord 120. A plurality of outlet hoses 110 are engaged or connected with openings formed in a building or structure to be dried. As can be seen, the portable placement of the system 100 provides great flexibility in directing the pressurized outlet air to desired locations. The flexible outlet hoses 110 are also capable of extending to numerous horizontal locations and to various heights. These aspects of the system 100 provide further flexibility and efficacy of the system 100 in directing pressurized outlet air to desired locations to speed the drying of water damaged structures.

Figure 5:
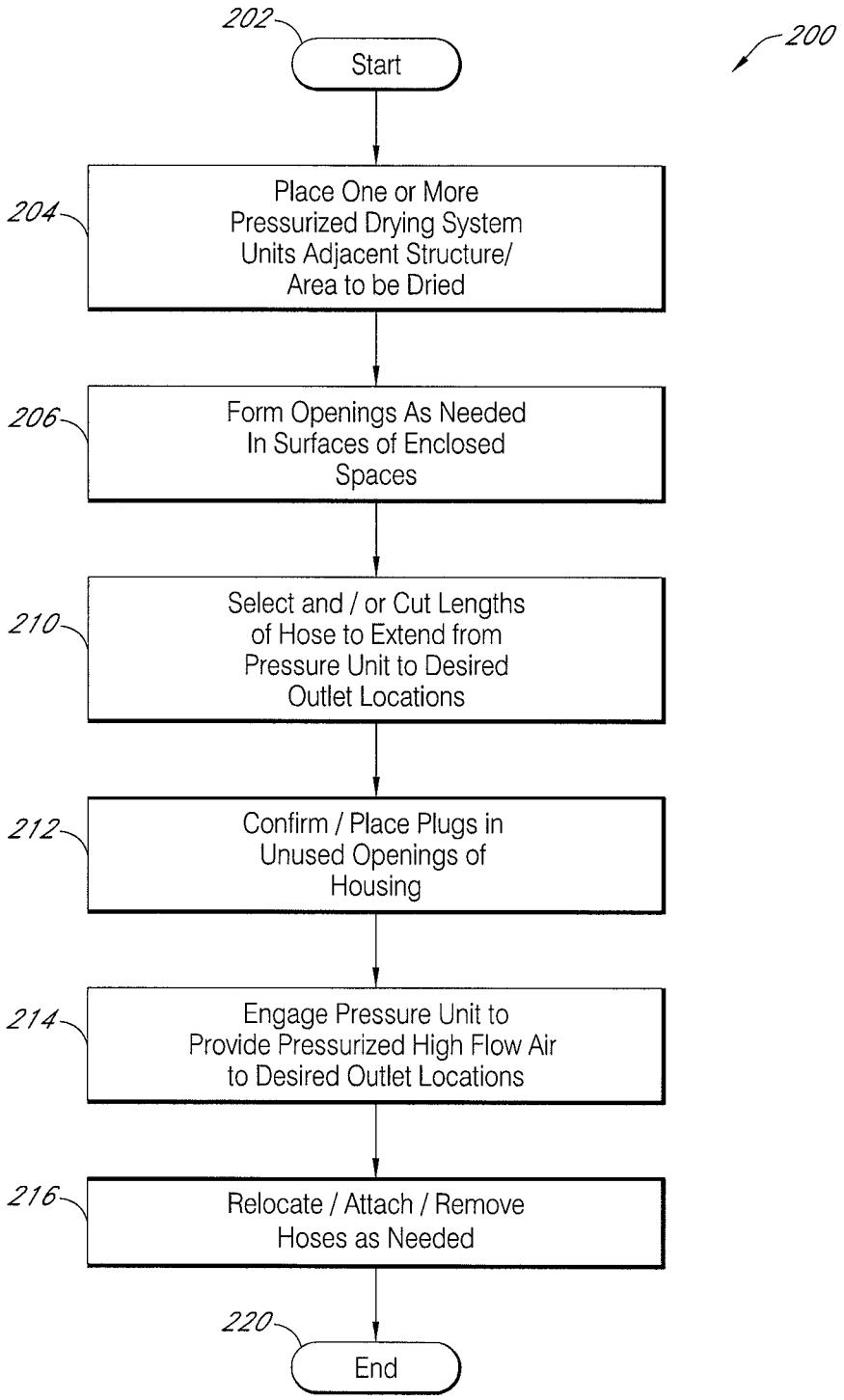
FIG. 5 is a flow chart of embodiments of methods of use of a pressurized drying system.

FIG. 5 illustrates a method or process 200 of using the pressurized drying system 100 to facilitate drying a structure or building that has received undesired exposure to water. A start block 202 corresponds to purchase, renting, or otherwise obtaining one or more of the systems 100 previously described and any necessary assembly.

In a block 204, the user places one or more of the pressurized drying systems 100 adjacent a structure or area to be dried. In a block 206, openings are formed as needed in surfaces of enclosed spaces. Conventional drying blowers that simply direct a stream of air in a selected direction, such as into a room of a building are less effective in drying the structure. There are frequently portions, such as the interiors of walls that are obstructed or occluded from the air flow generated by a simple air blower. In the block 206, the user drills, punches, or otherwise forms openings into the interiors of closed spaces to allow the system 100 to direct air flow therein. In one nonlimiting preferred embodiment, a user would drill or punch approximately half-inch holes where air flow from the system 100 is desired.

In a block 210, the user selects and/or cuts lengths of the flexible hose 156 to extend from a pressure unit of the system 100 to desired outlet locations that can include one or more of the openings formed in block 206. In one embodiment, the flexible hose 156 of the outlet hoses 110 comprises half-inch outside diameter flexible tubing and thus distal ends of the flexible hose 156 can engage with openings formed in block 206 via a friction fit.

As illustrated in FIG. 4, in some implementations, different lengths of flexible hose 156 may be needed to extend from the housing 102 to a desired outlet location. As indicated in block 210, a user can select from a plurality of different lengths of flexible hose 156 to achieve desired lengths. In some embodiments, the flexible hose 156 can be provided in bulk and a user can cut a desired length of flexible hose 156 to extend from the housing 102 to the desired outlet location. The flexible hose 156 can be readily removed from a corresponding fitting 154 and replaced with a different length of flexible hose 156. Alternatively or in addition to, a fitting 154 and attached flexible hose 156 can be removed or moved from a given opening 150 and replaced with a different fitting and attached flexible hose 256, for example a flexible hose 156 of different length and/or size.

In a block 212, the user confirms that plugs 152 are fitted in any unused openings 150 and places the plugs 152 in the openings 150 as needed. Again, as previously noted it will generally be preferred that each opening 150 be fitted either with a plug 152 or a fitting 154 with attached flexible hose 156, however this is not a requirement.

In a block 214, the user engages a pressure unit, for example comprising the vacuum motor assembly 104 as engaged with the housing 102 to generate and provide a pressurized high flow airstream to desired outlet locations. The system 100 would then be allowed to operate for some period of time sufficient to circulate air around and within the structure sufficient to thoroughly dry and remove the undesired water. The length of time required will typically vary among different jobsites, however will be readily apparent to one of ordinary skill.

In some implementations it may be preferred to relocate one or more of the outlet hoses 110 or otherwise adjust the output characteristics and/or locations of the system 100. For example, different regions of a structure may dry at different rates and outlet hoses 110 can be removed from portions of the structure that have dried sufficiently. If a given outlet hose 110 is no longer required for a given job, the corresponding opening 150 can be sealed with a corresponding plug 152 such that the output of the pressurized drying system 100 is substantially directed solely through the outlet hoses 110 in use.

Block 220 corresponds generally to end of use of the pressurized drying system 100 at a given job, however it will be understood that additional steps in the restoration/remediation of water damage may be indicated. It will further be understood that the flow chart illustrated in FIG. 5 is simply exemplary of certain process steps that can be employed in use of the system 100 and the particular order of process steps as illustrated and described is not essential to practicing the invention.

Although the above disclosed embodiments of the present teachings have shown, described and pointed out the fundamental novel features of the invention as applied to the above-disclosed embodiments, it should be understood that various omissions, substitutions, and changes in the form of the detail of the devices, systems and/or methods illustrated may be made by those skilled in the art without departing from the scope of the present teachings. Components, devices, and features and may be added, removed, or rearranged in different embodiments. Similarly processing steps be added, removed, or reordered in different embodiments. Accordingly, the scope of the invention should not be limited to the foregoing description but should be defined by the appended claims.

What is claimed is:

1. A system for drying structures comprising:

an enclosed housing having a tangential discharge wherein the tangential discharge is comprised of an array of plurality of outlet openings arranged into a grid that are formed on a wall that is perpendicular to the air flow wherein the enclosed housing is sealed such that the air inside the enclosed housing is pressurized so as to flow out of the plurality of outlet openings;

a plurality of flexible outlet hoses each connected to a respective outlet opening; and a vacuum motor comprising an enclosed housing and an air inlet wherein the vacuum motor sucks air into the enclosed housing through the air inlet and so that the vacuum motor heats the air and wherein the vacuum motor is engaged with the housing such that an outlet of the vacuum motor is exhausted into an interior of the sealed housing so as to pressurize the interior of the housing with heated air such that pressurized and heated air is directed through the plurality of outlet hoses.

2. The system of claim 1, further comprising plugs configured for substantially air tight connection to the outlet openings such that the compressed air in the interior of the housing is substantially directed solely through the plurality of outlet hoses.

3. The system of claim 1, further comprising a plug-off assembly configured to receive and secure unused outlet hoses and to bleed off pressurized air from the unused outlet hoses.

4. The system of claim 1, further comprising a thermal protection configured to monitor one or more temperatures of the system and automatically interrupt power to the vacuum motor when one or more of the monitored temperatures exceeds a threshold.

5. The system of claim 4, wherein the thermal protection is further configured to automatically restore power when the one or more monitored temperatures return to within the threshold.

6. The system of claim 1, wherein the plurality of outlet hoses are of a plurality of different lengths so as to be extendable different distances from the housing.

7. The system of claim 1, wherein the interior of the housing is pressurized to a pressure of between 2 and 6 psig.

8. The system of claim 1, wherein the system provides a total air output volume of 50 to 150 cfm.

9. The system of claim 1, wherein the outlet hoses are connected to the housing via interposed removable fittings.

10. The system of claim 1, wherein the vacuum motor comprises a generally tangential outlet and wherein the housing defines a generally spiral cross-section and wherein the tangential outlet is arranged to direct air from the vacuum motor generally tangentially along the spiral interior of the housing.

11. The system of claim 1, wherein the system further heats the pressurized air by 30 to 50° F. above ambient.

12. A method of drying an interior of a structure having walls, the method comprising:

placing a pressurized drying system adjacent a region of a structure that is desirably dried wherein the pressurized drying system includes an enclosed housing having a tangential discharge wherein the tangential discharge is comprised of an array of outlet openings arranged in a grid that are formed on a wall that is perpendicular to the air flow;

forming a plurality of openings in surfaces of the walls of the structure where the surfaces define enclosed spaces;

inserting ends of the outlet hoses into the plurality of outlet openings formed in the tangential discharge inserting distal ends of outlet hoses of the pressurized drying system into respective openings of the surfaces of the structure; and engaging the pressurized drying system so as to generate a flow of pressurized air and to direct the pressurized air into the enclosed spaces so that the pressurized air is delivered directly to the enclosed space via the openings formed in the walls of the structure.

13. The method of claim 12, further comprising selecting individual outlet hoses from among a plurality of different lengths of outlet hoses for insertion into the respective opening so as to reduce an excess length of hose beyond a minimum required to extend from the pressurized drying system to the respective opening.

14. The method of claim 12, further comprising cutting desired lengths of flexible tubing from a bulk supply of the tubing and connecting the desired lengths of flexible tubing to the pressurized drying system so as to form the outlet hoses.

15. The method of claim 12, further comprising placing plugs in any unused outlets of the pressurized drying system such that pressurized air from the pressurized drying system is substantially directed solely through the outlet hoses.

16. The method of claim 12, further comprising securing any unused outlets of the pressurized drying system to a plug-off assembly.

17. The method of claim 12, further comprising repositioning one or more of the outlet hoses to a different opening in one of the surfaces of the structure and reengaging the pressurized drying system.

18. The method of claim 12, wherein generating the pressurized flow of air comprises pressurizing the air to between 2 and 6 psig.

19. The method of claim 12, wherein generating the pressurized flow of air comprises generating a total air output volume of 50 to 150 cfm.

20. The method of claim 12, wherein generating the pressurized flow of air comprises heating the air approximately 30 to 50° F. above ambient.

* * * * *